US008157530B2

(12) United States Patent
Krützfeldt et al.

(10) Patent No.: US 8,157,530 B2
(45) Date of Patent: Apr. 17, 2012

(54) LOCKING SUB-ASSEMBLY FOR CLOSING THE REMAINING GAP BETWEEN THE FIRST AND THE LAST OF A BLADE RING WHICH ARE INSERTED IN A CIRCUMFERENTIAL GROOVE OF A TURBOMACHINE, AND CORRESPONDING TURBOMACHINE

(75) Inventors: Joachim Krützfeldt, Muülheim an der Ruhr (DE); Markus Kunze, Hünxe (DE); Silvio-Ulrich Martin, Oberhausen (DE); Stefan Mutke, Lauf (DE); Kang Qian, Mülheim an der Ruhr (DE); Christoph Richter, Ibbenbüren (DE); Oliver Schneider, Wesel (DE); Peter Schröder, Essen (DE); Michael Schwarz, Mülheim (DE); Ulrich Waltke, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 958 days.

(21) Appl. No.: 12/087,316

(22) PCT Filed: Dec. 27, 2006

(86) PCT No.: PCT/EP2006/070226

§ 371 (c)(1),
(2), (4) Date: Jul. 1, 2008

(87) PCT Pub. No.: WO2007/077183

PCT Pub. Date: Jul. 12, 2007

(65) Prior Publication Data

US 2009/0016889 A1 Jan. 15, 2009

(30) Foreign Application Priority Data

Jan. 2, 2006 (EP) ..... 0600025

(51) Int. Cl.
*B64C 11/04* (2006.01)
*F03B 3/12* (2006.01)
*F04D 29/34* (2006.01)

(52) U.S. Cl. ..... 416/220 R; 416/215; 416/216; 416/217; 416/218

(58) Field of Classification Search ..... 416/204 R, 416/215, 216, 217, 219 R, 220 R, 218
See application file for complete search history.

(56) References Cited

U.S. PATENT DOCUMENTS

| | | | | |
|---|---|---|---|---|
| 2,421,855 | A | 6/1947 | Soderberg | |
| 2,857,134 | A | 10/1958 | Arkless | |
| 3,721,506 | A | 3/1973 | Anderson | |
| 5,639,191 | A * | 6/1997 | Womack | 408/1 R |
| 2002/0127105 | A1 | 9/2002 | Bachofner et al. | |
| 2004/0179945 | A1 | 9/2004 | Bachofner et al. | |
| 2006/0222502 | A1 * | 10/2006 | Hansen et al. | 416/220 R |

FOREIGN PATENT DOCUMENTS

| | | | |
|---|---|---|---|
| DE | 2934298 | A1 | 3/1980 |
| DE | 10310431 | A1 | 9/2004 |
| EP | 1457642 | A2 | 9/2004 |
| GB | 639320 | A | 6/1950 |
| GB | 659592 | A | 10/1951 |

* cited by examiner

*Primary Examiner* — J. H. Hur

(57) ABSTRACT

A closing assembly is provided. The closing assembly closes the gap remaining between the first blade and the last blade of a blade ring that is inserted in a peripheral groove of a turbo machinery, the assembly consisting of at least two lateral parts, at least one of which may be hooked onto a projection that forms an undercut in the peripheral groove and at least one securing element, which secures the parts from coming detached from the peripheral groove. To provide a particularly reliable closing assembly, the securing element is configured as a pin, joining the parts of the closing assembly in a non-positive fit.

10 Claims, 2 Drawing Sheets

LOCKING SUB-ASSEMBLY FOR CLOSING THE REMAINING GAP BETWEEN THE FIRST AND THE LAST OF A BLADE RING WHICH ARE INSERTED IN A CIRCUMFERENTIAL GROOVE OF A TURBOMACHINE, AND CORRESPONDING TURBOMACHINE

CROSS REFERENCE TO RELATED APPLICATIONS

This application is the US National Stage of International Application No. PCT/EP2006/070226, filed Dec. 27, 2006 and claims the benefit thereof. The International Application claims the benefits of European application No. 06000025.4 filed Jan. 2, 2006, both of the applications are incorporated by reference herein in their entirety.

FIELD OF INVENTION

The invention relates to a locking sub-assembly for closing the remaining gap between the first and the last blade of a blade ring which are inserted in a circumferential groove of a turbomachine, which sub-assembly comprises at least two side pieces, of which at least one can be interlocked with a projection, which forms an undercut, of the circumferential groove, and at least one locking element which secures the pieces against disengaging from the circumferential groove.

BACKGROUND OF THE INVENTION

Locking sub-assemblies of such generic type for example originate from EP 1 457 642 A2 and US 2002/0127105 A1. The two locking sub-assemblies essentially comprise two side pieces which are inserted in the remaining gap between the first and the last blade of a blade ring. Since each side piece interlocks in each case with a projection, which forms the undercut, of the circumferential groove, and as a result the two side pieces can be introduced into the gap, the two side pieces together, as seen in the axial direction, are narrower than the gap which is to be filled and closed. After installation of the two side pieces, a gap remains between these in turn which has to be filled with an intermediate piece. The intermediate piece secures the two side pieces against an axial displacement, which disengages the respective interlocking, and consequently against a disengaging from the circumferential groove. In order to secure the intermediate piece itself against disengaging, this is equipped in each case with two lip-like members which by plastic deforming are bent in each case into a pocket which is provided on each side piece. Consequently, the intermediate piece is interlocked with each side piece in a positive locking manner, as a result of which the two side pieces are also retained in the circumferential groove. US 2002/0127105A1, moreover, proposes that the intermediate piece is interlocked with the first and the last blade of the blade ring via a dovetail, whereas according to EP 1 457 642 A1 each side piece of the locking sub-assembly is interlocked with the first and the last blade of the blade ring. Consequently, a gap formation and gap enlargement between adjacent rotor blades and the locking sub-assembly in the circumferential direction is essentially prevented.

In the case of the known locking sub-assembly, however, it is disadvantageous that for removing the locking sub-assembly this has to be at least partially expensively destroyed in the region of the positive lock. Moreover, it is to be noted that the locking sub-assembly has to withstand the thermal and mechanical loads which occur, especially the centrifugal force which occurs during operation, if it is installed in the rotor of a turbomachine.

In addition, a blade root locking arrangement with a split nut which is formed from two elements, is known from laid-open specification DE 29 34 298. The two elements in this case are interlockable in each case with one of the projections of the circumferential groove. By screwing in of a grub screw, the two elements are held at a distance and therefore interlocked.

Furthermore, a multi-piece locking sub-assembly, in which the pieces can be inserted simultaneously into the remaining gap, is known from GB 659 592. In this case, a screw is provided in the center intermediate piece which is conically formed in cross section. The screw which is supported on the groove base can raise the intermediate piece in the direction of the groove opening. On account of side faces which are arranged on the side pieces and inclined in a manner corresponding to the intermediate piece, these side faces can be securely interlocked in each case with the circumferential groove as a result of the raising of the intermediate piece.

Furthermore, a rotor lock for rotors of thermal turbomachines, which comprises locking halves, is known from DE 103 10 431 A1. The two locking halves in the installed state are interconnected by means of a dovetail fastening. In this case, the elements of the dovetail fastening are formed on the two halves in such a way that the dovetail fastening is created as a result of a displacement of the two halves towards each other, which is oriented in the circumferential direction. As a result of this, it is necessary that for closing the gap which exists between the first and the last blade of a blade ring by means of the rotor lock, a residual gap remains, as seen in the circumferential direction. Therefore, despite the use of the rotor lock of DE 103 10 431 A1, a further residual gap remains between the inserted rotor blades, which, however, can be distributed along the circumference of the circumferential groove.

SUMMARY OF INVENTION

Consequently, the object of the invention is the creation of a locking sub-assembly for complete closing of the remaining gap between the first and the last blade of a blade ring which are inserted in a circumferential groove of a turbomachine, which object can be simply and inexpensively achieved and which still reliably and durably withstands the high mechanical stresses.

For achieving the object, according to the invention a generic-type locking sub-assembly is disclosed, which is configured according to the features of the claims.

According to the invention, the pieces are inserted one after the other into the circumferential groove and then releasably interconnected by means of a pin-like locking element. Previously, in the case of the prior art, the locking element, which was formed as an intermediate element, was retained in a positive locking manner between the side pieces, so that the locking sub-assembly as a whole was secured against disengaging from the circumferential groove. The invention is now based on the knowledge that contrary to the current conception a releasable connection of the pieces of the locking sub-assembly reliably achieves the object. Furthermore, the locking sub-assembly can be disengaged from the circumferential groove, without being damaged, by the inserted locking element also being removed by a suitable tool. Furthermore, all the pieces which have already been used once can be used again, which saves production costs. For example, the releasable connection can be produced by means of a locking screw.

Moreover, with the invention a first development is firstly also disclosed, in which only the side piece which is inserted first into the circumferential groove, for example the front side piece, is interlockable with a projection of the circumferential groove. The rear side piece of the locking sub-assembly, as the second inserted piece, serves for covering the remaining opening of the gap after inserting the first side piece. In addition, the second side piece prevents a displacement of the first side piece, which would release its interlocking. The centrifugal force loading which acts upon the two side pieces of the locking sub-assembly is altogether absorbed by the projection which is interlocked with the first side piece. Consequently, the first side piece which is interlocked with the projection prevents disengaging of the locking sub-assembly as a whole from the circumferential groove.

In order to prevent an axially-oriented gap formation between two abutting pieces due to a clearance formation or due to the locking element pressing the pieces apart, these pieces are interlocked in a positive locking manner via a dovetail guide. The dovetail guide, therefore, enables an interlocking of two abutting pieces of the locking sub-assembly, which ensures a releasable and, depending upon requirement, an especially reliable non-positive connection of the pieces of the locking sub-assembly by means of the locking element. An undesirable disengaging of the locking element as a result of pieces which grip round the locking element moving away from each other, is therefore safely avoided.

Advantageous developments of the inventions are disclosed in the dependent patent claims.

The dovetail guide in this case is preferably arranged on the pieces of the locking sub-assembly in such a way that during the radial inserting of the last piece the elements of the dovetail guide intermesh. During the insertion process of the last piece, this is interlocked together with the already inserted piece, or with the already inserted pieces. This has the advantage that the locking sub-assembly can completely fill up, i.e. without clearance, the gap of the circumferential groove which is to be filled, as seen in the circumferential direction. Displacing of the rotor blades which are inserted in the circumferential groove, both after installation of the locking sub-assembly and during operation of the turbomachine, can be safely avoided in this way.

Within the scope of a second development of the invention, the locking sub-assembly comprises an intermediate piece, which can be inserted between the two side pieces which are now interlockable in each case with the circumferential groove. Since each side piece is interlockable in each case with an encompassing projection on a side wall of the circumferential groove, which projects in the axial direction, and the two side pieces are inserted one after the other into the circumferential groove, a farther gap remains between these which is filled by the subsequently inserted intermediate piece. The filling of the further gap prevents the displacement of the side pieces in the axial direction, so that their secure interlocking remains ensured. The locking element is arranged so that both the two side pieces and the intermediate piece, which lies between them, of the locking sub-assembly are releasably interconnected. The individual pieces of the locking sub-assembly, and this sub-assembly as a whole, are then secured against disengaging from the circumferential groove.

An especially favorable securing against disengaging from the circumferential groove is provided if the locking sub-assembly comprises a further pin-like locking element, wherein each side piece is secured with the intermediate piece in each case by means of one of the two pin-like locking elements. Therefore, each locking element interconnects only two of the three pieces of the locking sub-assembly, as a result of which the mechanical load of each locking element, compared with the development with only one locking element, is lower.

In an especially advantageous development of the invention, the two abutting side pieces abut, or each side piece abuts, upon the intermediate piece in a contact plane, wherein the locking element extends, or the locking elements extend, longitudinally within the contact plane. The locking element is accordingly arranged in halves in the contact plane and releasably interconnects in each case two abutting pieces.

Alternatively to the last-mentioned development, the locking element, or the locking elements, can extend transversely through the contact plane, through one of the two contact planes, or through the two contact planes.

A releasable locking sub-assembly can be especially advantageously achieved by a non-positive locking connection. The centrifugal force load which acts upon the two non-positive locking interconnected side pieces of the locking sub-assembly is altogether absorbed by the projection, or the projections, which is, or are, interlocked with the side piece, or the side pieces.

An especially simply releasable locking sub-assembly can be disclosed by a further development in which the locking element is a locking screw. The locking screw interconnects at least two pieces of the locking element in a non-positive locking manner. At least one threaded section is provided for the locking screw in each piece of the locking sub-assembly. The aligning threaded sections accommodate a common locking screw for the non-positive locking connecting of the pieces, if applicable, so that the locking screw extends transversely through the contact plane on which the two pieces abut. Alternatively to this, the thread can be divided over its whole height into two thread halves, wherein each half of the thread is arranged on one of the pieces of the locking sub-assembly. By this it is to be understood that each thread flight of the thread is divided into two halves, wherein one half is provided on a first of two pieces which abut in a contact plane, and the other half of each thread flight is arranged on the second of the two abutting pieces. Although the halves are referred to as such, these do not have to be identical in size.

By the use of a locking screw, a particularly reliable and re-releasable and, if applicable, non-positive locking connection of the pieces of the locking sub-assembly is provided, which, even with a centrifugal load acting upon the locking sub-assembly, safely prevents disengaging of the pieces of the locking sub-assembly from the circumferential groove. Moreover, the locking screw, on account of the friction forces of this screw which are increased as a result of the centrifugal force, is secured against loosening.

In particular, the provision of the dovetail guide safely prevents the two thread halves from moving away from each other, as a result of which the loosening of the locking screw, which is gripped by them, is reliably avoided.

In order to maintain a particularly aerodynamic surface of the locking sub-assembly, which closes off the opening of the gap in an approximately flush manner, the locking screw is formed as a grub screw so that the end which is required for screwing-in and unscrewing does not require additional space for a rotating tool.

The development in which each piece can abut against a side wall which is formed by a projection, which forms the undercut, of the circumferential groove, is particularly advantageous. As a result of this, the whole locking sub-assembly is prevented from being able to twist as a unit inside the circumferential groove if the gap between the first and the last blade of the blade ring becomes larger in the circumferential direction for unforeseeable, reasons. Even for this case, a locking sub-assembly which is particularly reliable and secured against disengaging from the circumferential groove, is disclosed by the proposed development.

In order to disclose a locking sub-assembly which is particularly reliable and secured against disengaging from the circumferential groove, the locking element can additionally be mechanically secured against loosening, for example by means of peening.

The locking sub-assembly is customarily provided for closing the gap of a circumferential groove, which is arranged in a rotor of a turbomachine.

BRIEF DESCRIPTION OF THE DRAWINGS

The further explanation of the invention follows, with reference to the exemplary embodiments which are represented in the drawing.

In detail, in the drawing

DETAILED DESCRIPTION OF INVENTION

Figure 2:
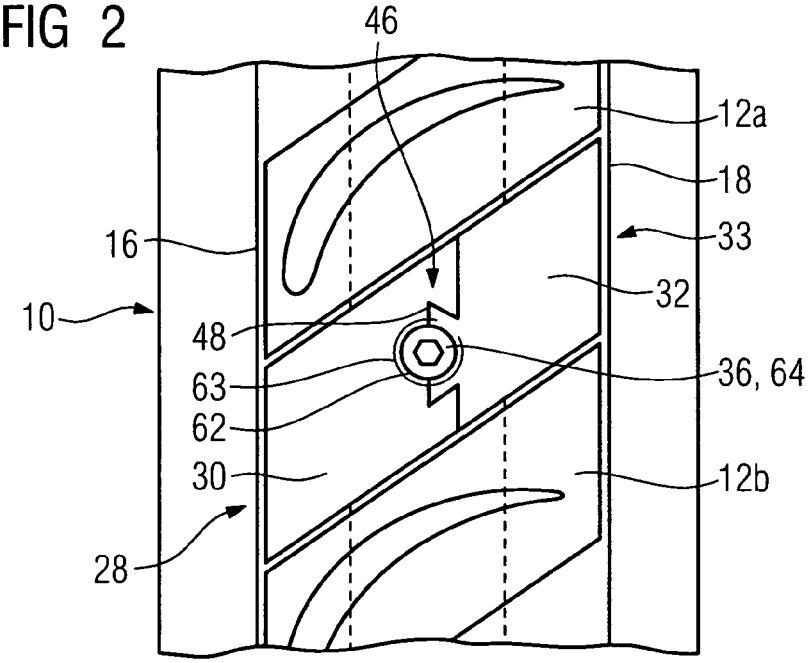
FIG. 2 shows the locking sub-assembly according to FIG. 1 in a plan view.
Figure 5:
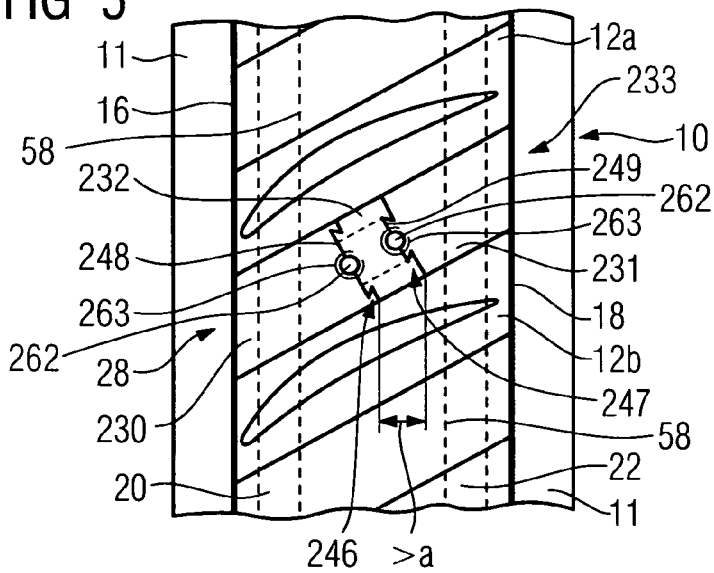
FIG. 5 shows the plan view according to FIG. 4
Figure 6:
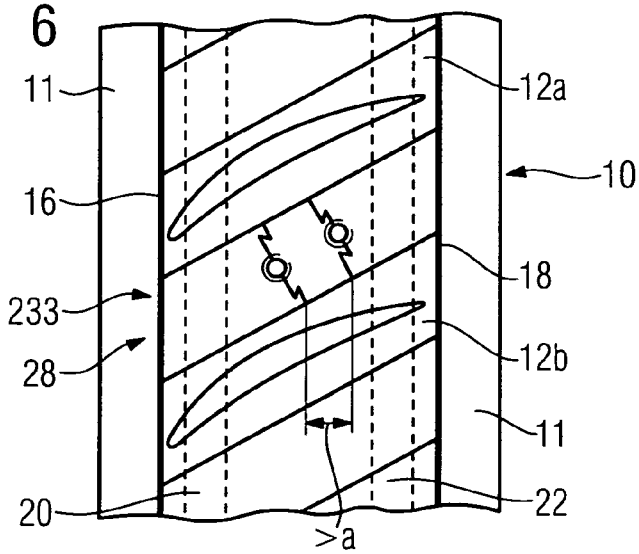
FIG. 6 shows the plan view according to FIG. 4 in a further embodiment variant.

FIG. 2, FIG. 5 and FIG. 6 show in each case a detail of a plan view of a circumferential groove 10, in which rotor blades 12*a*, 12*b* of an axial compressor of a gas turbine are inserted. Instead of the compressor, the invention could also be applied in a steam turbine or in a turbine unit of the gas turbine.

Figure 3:
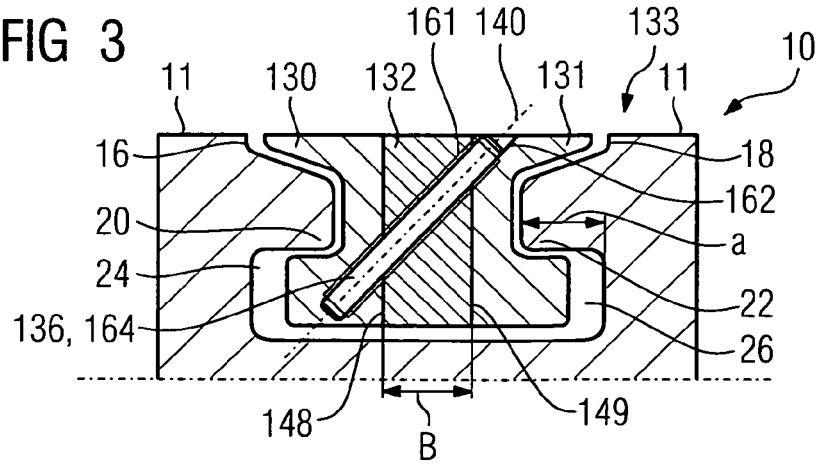
FIG. 3 shows a second development of the locking sub-assembly with a locking element which passes obliquely through the three pieces of the locking sub-assembly.
Figure 4:
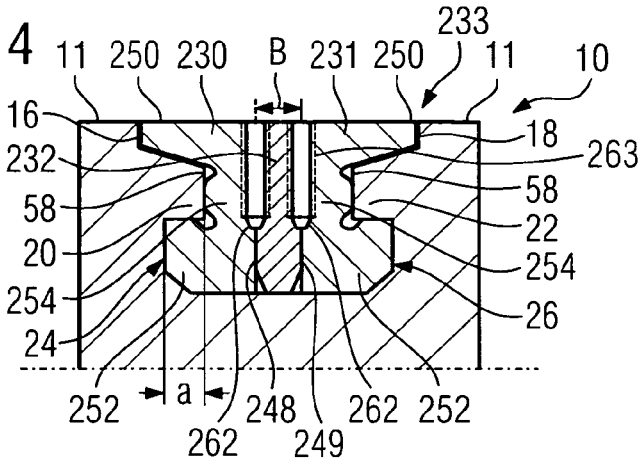
FIG. 4 shows a third variant of the invention with a locking sub-assembly which comprises three pieces and two locking elements.

The endlessly encompassing circumferential groove 10 is provided on an external surface 11 of the rotor of the compressor. The circumferential groove 10 could also be provided on an annular inner casing of the compressor, in which stator blades are fastened. The circumferential groove 10, as seen in the axial direction of the rotor, has a front side wall 16 and a rear side wall 18 upon which projections 20, 22, which extend in the circumferential direction and extend in the axial direction, are arranged in each case and respectively form a front and a rear undercut 24, 26 (FIG. 1, FIG. 3 and FIG. 4).

Rotor blades 12*a*, 12*b*, which have inverted T-shaped blade roots which are constructed to correspond to the undercuts 24, 26, are inserted in the circumferential groove 10. For installation, the rotor blades 12*a*, 12*b* are inserted into the circumferential groove 10 and then rotated enough, for example by 45° or 60°, until the inverted T-shaped blade roots fit behind the projections 20, 22.

The gap, which remains between the first rotor blade 12*a* and the last rotor blade 12*b*, of the circumferential groove which is otherwise completely fitted with blades 12 of a blade ring and, if applicable, intermediate pieces which are arranged between them, has to be closed by means of a special device, which is referred to as locking sub-assembly 33, blade lock or even rotor lock.

Figure 1:
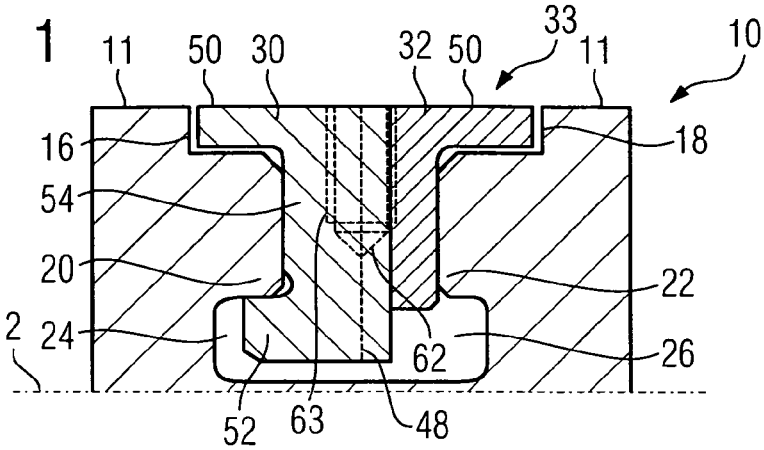
FIG. 1 shows a circumferential groove in cross-sectional view with a locking sub-assembly which comprises two side pieces and a locking element.

The first development of the invention, which is shown in FIG. 1 and FIG. 2, is essentially characterized in that the locking sub-assembly only comprises a front side piece 30 and a rear side piece 32, wherein only the front side piece 30 is interlocked with the projection 20 of the circumferential groove 10. The front side piece 30, as seen in cross section, is C-shaped in form (FIG. 1), and has an outer arm 50 and an inner arm 52 which are interconnected via a bridge 54 which extends in the radial direction. The inner arm 52 engages in the undercut 24 which is formed by the projection 20. Subsequently, the arm 52 abuts against the projection 20 and prevents falling out from the circumferential groove 10. The rear side piece 32 closes the opening of the gap 28 after the front side piece 30 has been inserted into the gap 28 of the circumferential groove 10. The first development of the invention is especially characterized in that the rear side piece 32, as seen in cross section, is simply L-shaped and not C-shaped like the front side piece 30. The rear side piece 32 does not engage in the undercut 26 and is not interlocked with the projection 22.

The front side piece 30, as shown in FIG. 2, is interlocked with the rear side piece 32 in a positive locking manner via a dovetail guide 46. The dovetail guide 46 comprises two elements, these being a recess with undercuts, and an extension which is formed correspondingly to it and which can fit behind the undercuts of the recess. One each of the elements is provided on one of the pieces which is interlockable with the dovetail guide. Both the recess with the undercuts and the extension, as seen in cross section, that is to say perpendicular to the guide direction, have in this case a contour in the form of a dovetail.

The dovetail guide 46 of the locking sub-assembly 33 is oriented so that during the radial inserting of the rear side piece 32 into the circumferential groove 10 this is interlocked with the front side piece 30 which is already inserted. The dovetail guide 46 prevents a possible gap formation between the two side pieces 30, 32.

The front side piece 30 and the rear side piece 32 abut in a contact plane 48. A hole 62 which has a female thread 61, in which the locking element 36, which is formed as a locking screw 64, is screwed, is provided in the contact plane 48. The female thread 61 is arranged in halves in the front side piece 30 and in the rear side piece 32. In halves means that one half of each thread flight of the female thread 61 is formed on the front side piece 30, and the other half of each thread flight is formed on the rear side piece 32.

By the screwing-in of a locking screw 64, which for example is formed as a grub screw, into the female thread 61, the two side pieces 30, 32 are interconnected in a way in which they can be released again. The grub screw can be tensioned in the tapering female thread 61, forming a particularly tight frictional lock. By means of the axial gap formation between the two pieces 30, 32, which is prevented by the dovetail guide 46, the locking screw 64 is reliably screwed into the female thread 61, although this is formed by two separate pieces 30, 32.

The assembled locking sub-assembly 33 is retained as a whole in the circumferential groove 10 via the interlocking of the front side piece 30 with the projection 20 and therefore is secured against disengaging from the circumferential groove 10.

The rear side piece 32 is securely retained in the circumferential groove, despite a faulty interlocking with the projection 22, since the centrifugal forces which act upon the rear side piece 32 are transmitted by means of the locking screw 64 onto the front side piece 30, so that the rear side piece 32 is indirectly also supported by the projection 20 which serves as an abutment for the interlocked inner arm 52.

Although the centrifugal forces which act upon the locking screw 64 and upon the two side pieces 30, 32 prevent a self-acting loosening of the locking screw 64, this can additionally be secured once more against unscrewing by means of peening, as a result of which a locking sub-assembly 33, which is particularly secured against disengaging from the circumferential groove 10, is disclosed.

FIG. 3 shows a second development of the invention, in which the locking sub-assembly comprises three pieces 130, 131, 132 which are inserted into the gap 28. The two lateral side pieces 130, 131, which are C-shaped in cross section, are individually inserted one after the other into the circumferential groove 10 and axially displaced so that their inner arms 52 are interlocked in each case with the projections 20 or 22 by each arm 52 engaging in each case in one of the undercuts 24, 26. After that, the gap which remains between these two side pieces 130, 131 is filled by the inserting of an intermediate piece 132, which secures the two side pieces 130, 131 against axial displacement and prevents loosening of the interlock. The intermediate piece 132 has a width B, extending in the axial direction, which corresponds at least to the dimension a by which the projection 20 or 22 penetrates into the circumferential groove 10 in the axial direction.

The pieces 130 and 132 abut in a contact plane 148, and the pieces 131 and 132 abut in a contact plane 149. A hole 162 extends obliquely through the contact planes 148 and 149. In order to interconnect the pieces 130, 131, and 132 in a non-positive locking manner, a pin-like locking element 136 is provided, which can be inserted into the hole 162. The hole 162 extends along an axis 140 which obliquely penetrates the contact faces 148, 149 and penetrates the three pieces 130, 132, 131 in alignment. A female thread 161 is provided inside the hole 162, into which the locking element 136, which is formed as a locking screw 164, can be screwed. Consequently, the three pieces 130, 131, 132, which have in each case a threaded section, are releasably interconnected, as a result of which the intermediate piece 132 and also the locking sub-assembly 133 as a whole are secured against disengaging from the circumferential groove. It is even possible that only the intermediate piece 132 features the female thread 161 and that the locking screw 164 is supported on the groove base of the circumferential groove 10 in order to secure the locking sub-assembly 133 as a whole. Furthermore, instead of a support on the groove base of the circumferential groove, a locking screw 164, which is provided with a screw head, can clamp the side pieces 130, 132 together in a non-positively locking manner.

Likewise, the pieces 130, 131, 132 of the locking sub-assembly 133 can be interlocked by a dovetail guide according to the first development.

Alternatively to the development which is shown in FIG. 3, the three pieces 130, 132, 131 could also be secured by means of two locking elements which are axially offset to each other. For this case, the locking element 136 would only interconnect the side piece 131 with the intermediate piece 132 in a non-positively locking manner, and a further locking element, which is not shown and also extends obliquely, would only interconnect the two pieces 130 and 132 in a non-positively locking manner. In addition, in the second development a dovetail guide can also interconnect the pieces 130, 132, and 131, 132.

FIG. 4 shows a third development of the invention in a cross-sectional representation, and FIG. 5 shows this third development in a plan view. The side pieces 230, 231, which can be inserted one after the other into the circumferential groove 10, are interlocked in each case with one of the projections 20 or 22. The two side pieces 230, 231 are essentially C-shaped in form, as seen in cross section, and have in each case an outer arm 250, which partially closes the gap 28 partially on the outside, and an inner arm 252, which is interlocked with the projections 20, 22. The inner arms 250 are interconnected with the outer arms 252 in each case by means of a bridge 254.

An intermediate piece 232 is provided between the two side pieces 230, 231, which secures the two side pieces 230, 231 against axial displacement and therefore against loosening of the interlock. The intermediate piece 232 has a width B, extending in the axial direction, which corresponds at least to the dimension a by which each projection 20 or 22 penetrates into the circumferential groove 10 in the axial direction.

If this condition is not fulfilled, then the side piece 130 or 131, which is to be inserted into the groove as the second side piece, cannot be inserted.

FIG. 5 shows the plan view of the third development of the invention according to FIG. 4. The intermediate piece 232 abuts against the front side piece 230 in a contact face 248, and is interlocked with this via a first dovetail guide 246. For this purpose, a dovetail-shaped extension is formed on the intermediate piece 232, and the corresponding recess which is associated with it is formed on the front side piece 230. In a similar manner, the rear side piece 231 is interlocked with the intermediate piece 232, wherein these abut in a contact face 249. In the case of the second dovetail guide 247, or dovetail toothing, the dovetail-shaped extension is provided on the rear side piece 231, and the recess which is formed correspondingly to it is provided on the intermediate piece 232. In this case, the second dovetail guide 247, as seen in the circumferential direction, can be constructed narrower than the first dovetail guide 246 in order to enable an axial sliding of the narrower dovetail-shaped extension in the larger recess during installation of the side piece 231 or 230 which is inserted as the second side piece, and in this way to achieve a maximization of the centrifugal force-stressed cross sections of the bridges 254.

In a similar way to the first development according to FIG. 1 and FIG. 2, a pin-like locking element 236, which is formed as a locking screw 264, is provided in each case in the contact faces 248, 249. At least one hole 262 is provided in each contact plane 248, 249 for accommodating the locking element 236. Each hole 262 is provided with a female thread 263 which are arranged in each case in halves in two pieces 230, 231, and 231, 232. The pin-like locking element 236, which is formed as a locking screw 264, can be screwed in each case into this female thread 263 for the non-positive and/or positive connecting of the pieces 230, 231, 232 of the locking sub-assembly 233. Although each female thread 263 is arranged in each case in halves in two pieces 230, 232, and 231, 232, a threaded connection which is reliable and secured against loosening is possible, since by means of the respective dovetail guide 246, 247 the two pieces 230, 232, or 231, 232 which form each female thread 263 cannot be axially moved apart.

FIG. 6 shows the plan view of a variant of the third development. In this case, the dovetail guide 247 is formed between the pieces 232 and 231 the other way round in relation to FIG. 5. The two dovetail-shaped extensions are arranged on the intermediate piece 232, and each side piece 230, 231 has a recess in the corresponding contact faces 248, 249 for accommodating the respective extension.

If in the exceptional case the blades 12 of the blade ring wander so that a gap occurs between the locking sub-assembly 33, 133, 233 and a directly adjacent blade 12*a* or 12*b*, the locking sub-assembly as a whole could possibly disengage from the circumferential groove 10 by rotating. This can be prevented by the bridges 54, 254 of each side piece 30, 32, 130, 131, 230, 231 abutting against the side walls 58 of the projections 20, 22 like a flange, as FIG. 4 exemplarily shows it.

Instead of a locking screw 64, 164, 264, a pin-like bolt, which is secured against loosening by means of a press fit, could also be inserted into the hole 62, 162, 262. For removing the locking sub-assembly, this bolt would have to be simply drilled out.

Furthermore, a locking screw 64, 164, 264, which is provided with a screw head, could be screwed into each locking sub-assembly 33, wherein the screw head, which is recessed in one or more of the pieces 30, 32, 130, 131, 132, 230, 231, 232, abuts against this with pretensioning in a non-positively locking manner.

In all, by the locking sub-assembly a device for closing the remaining gap between the first and the last blades of a blade ring which are inserted in a circumferential groove, can be disclosed, which can be easily installed and disassembled. Since the installation of the locking sub-assembly does not necessitate plastic deformation of the components, but proposes the non-positive locking connection of the components, these can be loosened and disassembled by means of working steps carried out in reverse. All the components of the locking sub-assembly can be used again. Moreover, the simple type of construction enables a relatively favorable manufacturing cost.

The invention claimed is:

1. A locking sub-assembly for closing a remaining gap between a first blade and a last blade of a blade ring inserted in a circumferential groove of a turbomachine, comprising:

a plurality of side pieces wherein at least one of the side pieces is interlockable with a projection which forms an undercut of the circumferential groove; and a pin-like locking element which secures the side pieces against disengaging from the circumferential groove and which releasablv interconnects the side pieces wherein each side piece is interconnected with an intermediate piece arranged between the side pieces, via a dovetail guide in each case, wherein the dovetail guide is arranged on the side pieces such that during a radial insertion of the last side piece, the elements of the dovetail guide intermesh, wherein each side piece is secured with the intermediate piece via one of two pin-like locking elements in each case.

2. The locking sub-assembly as claimed in claim 1, wherein the side pieces abut each other in a contact plane, or each side piece abuts against the intermediate piece in a contact plane, wherein the locking element, or elements, extends, longitudinally within the contact plane.

3. The locking sub-assembly as claimed in claim 1, wherein the side pieces abut each other in a contact plane, or each side piece abuts against the intermediate piece in a contact plane, wherein the locking element, or elements, extends, transversely through the contact plane.

4. The locking sub-assembly as claimed in claim 3, wherein the locking element interconnects the side pieces in a non-positive locking manner.

5. The locking sub-assembly as claimed in claim 4, wherein the locking element is a locking screw.

6. The locking sub-assembly as claimed in claim 5, wherein the locking screw is a grub screw.

7. The locking sub-assembly as claimed in claim 6, wherein each piece abuts against a side wall formed by a projection that forms the undercut of the circumferential groove.

8. The locking sub-assembly as claimed in claim 7, wherein the locking element is secured against loosening.

9. A turbomachine, comprising:

a rotor with at least one circumferential groove having undercuts and a plurality of rotor blades fastened within the rotor groove; and a locking sub-assembly arranged between a first rotor blade and a last rotor blade inserted in the circumferential groove that fully closes a gap between the first and last blades where the sub assembly comprises:

a plurality of side pieces wherein at least one of the side pieces is interlockable with a projection which forms an undercut of the circumferential groove, and a pin-like locking element which secures the side pieces against disengaging from the circumferential groove and which releasably interconnects each side piece is interconnected with an intermediate piece arranged between the side pieces, via a dovetail guide in each case, wherein the dovetail guide is arranged on the side pieces such that during a radial insertion of the last side piece, the elements of the dovetail guide intermesh, wherein each side piece is secured with the intermediate piece via one of two pin-like locking elements in each case.

10. The turbomachine as claimed in claim 9, wherein the turbomachine is a turbine of a gas turbine, as a compressor, or as a steam turbine.

* * * * *